United States Patent [19]

McLaughlin et al.

[11] 4,233,171

[45] * Nov. 11, 1980

[54] DISHWASHING DETERGENT EFFECTIVE AT LOW TEMPERATURE

[75] Inventors: Robert L. McLaughlin, Wilmette; Donald C. Wood, Des Plaines, both of Ill.

[73] Assignee: DeSoto, Inc., Des Plaines, Ill.

[ * ] Notice: The portion of the term of this patent subsequent to Feb. 5, 1997, has been disclaimed.

[21] Appl. No.: 941,185

[22] Filed: Sep. 11, 1978

Related U.S. Application Data

[63] Continuation-in-part of Ser. No. 872,761, Jan. 27, 1978, Pat. No. 4,187,190, and Ser. No. 737,588, Nov. 1, 1976, abandoned.

[51] Int. Cl.[3] ..... C11D 7/56; C11D 7/18; C11D 7/38

[52] U.S. Cl. ..... 252/99; 252/135; 252/DIG. 1; 252/358; 252/321; 252/174.14; 252/174.22; 252/174.23

[58] Field of Search ..... 252/99, 135, DIG. 1, 252/89 R, 358, 321, 174.14, 174.22, 174.23

[56] References Cited

U.S. PATENT DOCUMENTS

| | | | |
|---|---|---|---|
| 3,549,539 | 12/1970 | Mallows | 252/89 X |
| 3,899,436 | 8/1975 | Copeland et al. | 252/135 X |
| 4,049,586 | 9/1977 | Collier | 252/135 X |

*Primary Examiner*—Mayer Weinblatt

*Attorney, Agent, or Firm*—Dressler, Goldsmith, Shore, Sutker & Milnamow, Ltd.

[57] ABSTRACT

A machine dishwashing detergent which cleans at lower temperature combines a chelating agent with a water soluble oxidizing bleach in an alkaline environment and certain combinations of nonionic surfactants: A. a low-foaming water-soluble polyol which is a polyoxypropyleneterminated block copolymer having a polyoxyethylene core; B. an oil-soluble condensate of about 1 to about 5 moles of ethylene oxide with a hydrophobic organic compound containing a single -OH group; and C. a high-foaming water-soluble condensate of at least about 7 moles of ethylene oxide with a hydrophobic organic compound containing a single —OH group. When all three surfactants are used in an amount of at least about 1%, at least 4% of total surfactant is needed, and when fewer surfactants are used, a larger total amount is required.

16 Claims, No Drawings

DISHWASHING DETERGENT EFFECTIVE AT LOW TEMPERATURE

This application is a continuation-in-part of our prior applications Ser. Nos. 737,588 filed Nov. 1, 1976, now abandoned, and 872,761 filed Jan. 27, 1978, now Pat. No. 4,187,190.

TECHNICAL FIELD

This invention relates to machine dishwashing compositions having improved detergency at lower temperature. Conventionally formulated dishwashing detergents are not effective at temperatures below about 130° F. The detergents of this invention function effectively at about 110° F. where effective dishwashing was not hitherto believed to be possible. The saving in energy is considerable and important where energy conservation is the order of the day.

BACKGROUND ART

Synthetic detergents capable of performing a wide variety of household and industrial cleaning operations are known in the art and are formulated for optimized performance under the contemplated end use conditions. For example, machine dishwashing detergents are formulated for use in appliances in which a moving, high-velocity water spray is utilized for cleaning tableware and cooking utensils. The performance requirements for such a detergent differ substantially from the requirements for a laundry or hand-dishwashing detergent and include very low sudsing, effective rinsing to avoid residual deposits, thorough removal of food protein, carbohydrates and fats which can cause spot formation during drying, and sequestration of calcium and magnesium ions usually present in the water supply. Damage to the dishes being washed, such as etching of glassware, must also be avoided. Known detergents adapted for machine dishwashing as above described have not been able to function at temperatures below about 130° F. Starting with water at 60° F., if the temperature increase could be limited at 50° instead of the presently required 70° or more, a sizeable portion of the energy normally needed to heat the large volume of water used, could be saved. Also, and from the standpoint of environmental considerations, the presence of large amounts of phosphates or similar phosphorus-containing compounds in machine dishwashing detergents is undesirable, and it is also possible in this invention to provide a practical powder dishwashing composition containing only about 8 to about 20 weight percent of phosphorus-containing compounds (instead of the 25 to 60 weight percent normally needed) while retaining effective washing action at about 110° F.

It should also be observed that my said application Ser. No. 872,761 filed Jan. 27, 1978 employs selected phosphates and a carbonate-to-phosphate weight ratio of about 0.8:1 to about 1.3:1. These limitations do not apply to the present invention.

DISCLOSURE OF INVENTION

The present invention contemplates a machine dishwasher detergent which is effective at a lowered washing temperature. This low temperature machine dishwashing detergent consists essentially of:

a chelating agent capable of sequestering the calcium and magnesium ions expected to be present in the wash water;

an alkaline material providing an alkalinity of at least 12 percent alkali metal oxide;

a water-soluble, oxidizing bleach in an amount supplying about 0.4 to about 3.0 weight percent of the composition of an oxidizing component selected from the group consisting of chlorine and oxygen; and at least about 4 percent of certain combinations of the following three nonionic surfactants:

A. a low-foaming water-soluble polyol which is a polyoxypropylene-terminated block copolymer having a polyoxyethylene core;

B. an oil-soluble condensate of about 1 to about 5 moles of ethylene oxide with a hydrophobic organic compound containing a single —OH group; and C. a high-foaming water-soluble condensate of at least about 7 moles of ethylene oxide with a hydrophobic organic compound containing a single —OH group.

In these combinations, surfactant C is used in an amount of at least about 1% with the balance being at least 1% of either of surfactants A or B for a total of at least about 5%. When 1% or more of all three surfactants are used, the total may be as low as about 4%. When at least about 6% of total surfactants are employed, then surfactant A can be used alone or in combination with the other surfactants.

The chelating agent which is present in the formulations of this invention serves as a builder, i.e., a compound which sequesters or suspends polyvalent ions (usually $Ca^{+2}$ and $Mg^{+2}$) present in substantial quantities in the so-called hard water supply, so that these metal ions do not combine either with the components which are present or with the various soils, such as a lipid residues or carbohydrates, to form less soluble residues which tend to adhere tenaciously to the surfaces being cleaned. Many such chelating agents are known in the art and a comprehensive list is given in U.S. Pat. No. 4,049,586 to Collier. These include the phosphates, polyphosphates, phosphonates, polyhydroxysulfonates, polyacetates, carboxylates, polycarboxylates, and succinates.

Specific examples of inorganic type sequesterants include sodium and potassium tripolyphosphates, pyrophosphates, phosphates, and hexametaphosphates. The phosphonate types include the sodium and potassium salts of ethylene diphosphonic acid, and the sodium and potassium salts of ethane 1-hydroxy-1,1-diphosphonic acid.

Organic sequestering builders are also useful herein. For example, the alkali metal polyacetates, carboxylates, polycarboxylates, and polyhydroxysulfonates are useful in chelating builders in the present formulation. Specific examples of the polyacetate and polycarboxylate chelating salts include the sodium and potassium salts of ethylene diamine tetraacetic acid, nitrilotriacetic acid, oxydisuccinic acid, mellitic acid, benzene polycarboxylic acids, and citric acid.

In the preferred embodiments of this invention, sodium or potassium tripolyphosphate or sodium or potassium hexametaphosphate are used. In formulating these preferred embodiments, leeway is given for the differences between hard and soft waters likely to be encountered in various regions. As a practical matter, these embodiments have been formulated for the hardest water that is to be expected. Thus, in one embodiment, sodium tripolyphosphate is present in an amount of about 25 to about 65 weight percent of the mixture. More preferably, sodium tripolyphosphate is present in an amount of about 34 weight percent of the mixture.

In another embodiment of this invention, the amount of chelating agent can be drastically reduced when the amount of this agent is balanced with an approximately equal weight percentage of sodium carbonate as disclosed in our copending application, Ser. No. 872,761. In those embodiments, about 8 to about 20 weight percent sodium or potassium tripolyphosphate, or sodium or potassium hexametaphosphate may be used, preferably these phosphorus-containing compounds are present in an amount of about 17 weight percent which is about half the amount usually used, e.g., about 35 percent. The alkali metal carbonate, e.g., sodium carbonate or potassium carbonate, is present in an amount of at least 8 parts providing a carbonate-to-phosphate weight ratio of at least about 0.8:1, preferably at least about 2:1 and most preferably from 2.5:1 up to about 4:1. The corresponding bicarbonates or sesquicarbonates may also be used, if desired. It is important to note that the higher level of surfactant concentration required herein has permitted the use of very large amounts of carbonate component and this is economically advantageous.

During formulation, the carbonate may be added to the detergent composition in anhydrous form as well as in hydrated or partially hydrated form; however, the aforesaid amounts are based on anhydrous carbonate, any water present being ignored in calculating the proportions. The bicarbonate or sesquicarbonate can be substituted for the carbonate on an equi-weight basis.

An alkaline environment is employed in the present invention. The pH of a solution of these detergent compositions has been found to be less meaningful in defining the invention than the total alkalinity of the system which is calculated from the various alkaline materials present. The minimum alkalinity needed herein, as determined by calculation, corresponds to an amount of alkali metal oxide of at least 12 percent by weight. Preferably at least 20 percent by weight is used, and this may extend up to about 60 percent by weight, though more can be used industrially if sodium hydroxide were added.

The alkali metal oxide can be contributed by various alkaline compounds. For example, the chelating agent, such as sodium tripolyphosphate, can contribute alkalinity. Alkalinity is also provided by the addition of other water-soluble alkaline substances, such as alkali metal carbonates, bicarbonates, or sesquicarbonates, and these preferably provide at least 50% of the alkalinity which is calculated. Also alkali metal silicates or metasilicates, alkali metal borates, or the like may be present to provide alkalinity and these also may be relied upon for corrosion inhibition of metals. The term "alkali metal" denotes primarily sodium, though potassium is useful, especially in small amounts where excessive cost is avoided. Minor amounts of alkaline lithium and/or ammonium salts can be tolerated, but are not preferred. Minor amounts of sodium hydroxide and/or potassium hydroxide can be tolerated, but these materials are preferably avoided to minimize the hazard presented when items for home use, such as the machine dishwashing detergent as herein disclosed, contain lye or its equivalents.

A water-soluble oxidizing, bleaching agent is present in the detergent compositions of this invention. The bleaching agent can be based on a hypochlorite species which releases chlorine as the oxidizing component or upon a peroxygen species which releases oxygen as the oxidizing component. Illustrative chlorine-releasing leaches are sodium dichloroisocyanurate, potassium dichloroisocyanurate, trichloroisocyanuric acid, sodium hypochlorite, lithium hypochlorite, chlorinated trisodium phosphate, 1,3-dichloro-5,5-dimethyl hydantoin, and the like. Oxygen-releasing bleaches are illustrated by sodium perborate, sodium persulfate, potassium perborate and the like.

The water-soluble oxidizing bleach is present in the composition in an amount sufficient to supply about 0.3 to about 3 parts by weight of the desired oxidizing component, i.e., the active chlorine or active oxygen. As an example, a preferred composition of either high chelator or low phosphate content contains about 1.2 weight percent sodium dichloroisocyanurate which has about 57 percent active chlorine.

The minimum proportion of nonionic surfactant component is important. When at least about 1% of all three surfactants are present, a minimum of 4% is effective. When surfactant C is used with at least 1% of one other surfactant, then at least 5% is enough, and when 6% or more is used, surfactant A can be used alone, though the mixture of all three surfactants gives best results.

The blend of nonionic surfactants as previously described which makes up the surfactant mixture is particularly important in all embodiments of this invention. It is the specified proportion of this balanced mixture containing different surfactant types in the described environment which enables the dishwashing water temperature to be reduced with a concomitant savings in energy required to heat that water. The disclosed blend of surfactants is present in all forms of this invention regardless of chelator selection and proportion, and is thus used in both the low phosphate embodiments, and also in those embodiments having a normal phosphate concentration, i.e., about 35 weight percent phosphate. Up to about 10% by weight of the described surfactants are useful in the detergent composition of this invention, and up to about 20% can be tolerated, though this is wasteful.

The low-foaming nonionic surfactant is a water-soluble oxyalkylene block copolymer which is a polyol containing at least some terminal secondary hydroxyl groups. The hydrophobic element of the low-foaming nonionic surfactant is a polyoxypropylene chain which terminates the block copolymer, and the hydrophilic element thereof is a polyoxyethylene chain which constitutes an interior portion of the block copolymer. The low-foaming nonionic surfactants most suitable for the present purposes are the water-soluble polyoxypropylene-polyoxyethylene condensates having an average molecular weight of about 2000 to about 4000, and exhibit a foam height of about 5 millimeters, or less, when a 0.1 weight percent aqueous solution thereof at about 120° F. is sprayed through an orifice for 10 minutes in accordance with a test procedure described in greater detail hereinbelow. These condensates usually contain from about 2 to about 9 moles of propylene oxide per molecule of polyoxyethylene in the hydrophobic core.

Typical, illustrative low-foaming nonionic surfactants within the foregoing category are the water-soluble, liquid polyols having terminal secondary hydroxyl groups and a relatively low cloud point. These polyols are commercially available from BASF Wyandotte Corporation under the designation "Pluronic R". Particularly preferred is the water-soluble polyol having a molecular weight of about 3120 and cloud point of about 33° C. in a 1 percent aqueous solution, commercially available under the designation "Pluronic 25R2."

To facilitate the handling of oily and greasy substances which are encountered in dishwashing operations, an oil-soluble, liquid, nonionic surfactant that is made from an oil-soluble, hydrophobic alkanol having a relatively low degree of ethoxylation is incorporated into the surfactant blend. The alkanol portion of the surfactant molecule is usually an alkanol which contains about 6 to about 18 carbon atoms, and the degree of ethoxylation can be about 1 to about 5 moles of ethylene oxide per mole of the alkanol, preferably about 2–3.5 moles of ethylene oxide per mole of alkanol containing 10–15 carbon atoms. About 1–2 moles of ethylene oxide are sufficient for the shortest chain alkanols and about 3.5–5 moles of ethylene oxide are required for the longest chain alkanols.

Typical, illustrative oil-soluble liquid, nonionic surfactants are the ethoxylated primary linear alcohols commercially available from Shell Chemical Company under the designation "Neodol 25–3" and "Neodol 25–5," and which are derived from a mixture of ethoxylated $C_{12-15}$ primary linear alcohols containing, respectively, 3 moles and 5 moles of ethylene oxide per mole of alcohol. Neodol 25–3 is particularly preferred. Another particularly preferred material is a mixture of $C_6$–$C_{10}$ linear primary alcohols which mixture has been ethoxylated to such an extend that about 50 percent by weight of the final product is due to ethylene oxide moieties. This material is sold commercially under the designation "Alfonic 610–50-ethoxylate" and is available from the Conoco Chemicals Division of Continental Oil Company.

The high-foaming, nonionic surfactant present in the surfactant blend contemplated by the present invention preferably is a water-soluble, ethoxylated monohydric compound which is preferably a long chain alkanol to provide biodegradability. Water-solubility usually requires at least about 7 moles of ethylene oxide per mole of monohydric compound. Octyl or nonyl phenols adducted with ethylene oxide can be used in place of the alkanol. below about 6.5 moles of ethylene oxide per mole of alcohol induces significant water-insolubility. The monohydric portion of the surfactant molecule provides the hydrophobic base of the surfactant and usually employs an alkanol which contains at least about 8 carbon atoms, preferably about 12 to about 18 carbon atoms. With the least hydrophobic base of about 8 carbon atoms, about 6.5 moles of ethylene oxide will provide the needed water solubility.

The degree of ethoxylation can range up to about 45 moles of ethylene oxide per mole of alcohol, or higher, which enables solid surfactants to be provided, but liquids are preferred since these are sorbed and cannot segregate. Preferably the high-foaming, nonionic surfactant is an ethoxylated mixture of biodegradable primary linear $C_{12-15}$ alkanols having about 7 to about 9 moles of ethylene oxide per mole of alkanol.

Typical, preferred, high-foaming, nonionic surfactants are the water-soluble, liquid, ethoxylated alcohols commercially available from Shell Chemical Company under the designation "Neodol 25–7" and "Neodol 25–9" which are ethoxylated mixtures of primary linear $C_{12-15}$ alkanols containing, respectively, about 7 and 9 moles of ethylene oxide per mole of alkanol. Another preferred material of this class is a mixture containing about 20 percent $C_{12}$ and 80 percent $C_{14}$ primary alcohols, which mixture is ethoxylated to such an extent that about 60 weight percent of the product's weight is due to ethylene oxide moieties. This material is sold commercially under the designation "Alfonic 1412–60-ethoxylate" and is available from the Conoco Chemicals Division of Continental Oil Company.

The characterization "low-foaming" as used herein and in the appended claims means a foam height of about 10 millimeters or less generated in 10 minutes when a 0.1 weight percent aqueous solution of the surfactant at 120° F. (49° C.) is subjected to a test procedure whereby 10 liters of the solution are placed in a PYREX jar (10" dia.×10" high) equipped with a propeller-type stirrer, knife-blade heaters, a thermoregulator and a thermometer. A small centrifugal pump is arranged to circulate the solution contained in this jar through a calibrated glass flow meter to a jet orifice prepared from the base of a No. 20 Becton, Dickinson and Company hypodermic needle by enlarging the hole in the base with a No. 56 twist drill. The jet orifice is mounted coaxially inside a PYREX glass tube (51 mm.×910 mm.) which is placed vertically in the solution. The jet is positioned so that it is 600 mm. above the surface of the solution in the jar, and the PYREX tube is arranged to project 210 mm. below the surface of the solution.

The solution is brought to temperature by means of the knife blade heater and maintained at 120° F. by means of a thermoregulator. The centrifugal pump is started and a flow of 400 ml. of solution per minute is metered through the jet. The flow is adjusted by bypassing part of the stream back into the PYREX jar before passing through the flow meter. The solution passing through the jet is directed against the wall of the vertical tube while the flow is adjusted and the temperature equilibrated in order to prevent foaming prior to the actual determination. The jet is then arranged to pass the solution coaxially downward through the tube without touching the tube walls and to impinge upon the surface of the solution located in the PYREX tube. Timing is started from the instant the solution impinges on the liquid surface and the foam height is read at the end of 10 minutes. The foam height readings are obtained from a calibration on the outside of the PYREX tube with the zero mark being at the surface of the solution.

The characterization "high-foaming" as used herein and in the appended claims means a foam height greater than about 10 millimeters generated in the foregoing test.

An inert particulate filler which is water-soluble but does not precipitate calcium or magnesium ions at use concentrations usually makes up the remainder of the present detergent compositions. Suitable for this purpose are organic or inorganic compounds such as urea, sodium sulfate, sodium chloride, potassium chloride and the like. Generally, about 0 to about 60 parts by weight of the filler may be present in the detergent compositions. In preferred practice using large amounts of sodium carbonate to provide alkalinity, the need for inert filler is minimized.

If desired, minor amounts of various other adjuvants or additives, e.g., perfumes, coloring agents, moisture absorbing agents, flow control agents, foam depressants, soil suspending agents, soil anti-redeposition agents, and the like, can be incorporated into the present detergent formulations.

The detergent compositions of the present invention can be compounded from the ingredients discussed hereinabove in any convenient manner. For example, the powdered chelating agent and some of the powdered alkaline environment producer can be thoroughly mixed to produce an admixture. The blend of the liquid nonionic surfactants is then substantially uniformly mixed in with the produced admixture so as to produce a free-flowing product in which the liquid nonionic surfactants are sorbed on to solid admixture. Subsequently the remaining alkaline environment producer and the filler are blended in to produce a substantially uniform final product.

When machine dishwashing detergents are formulated as hereinabove described, the minimum wash water temperature of about 130° F. as previously employed in the art need not be used. Rather a wash water whose temperature is about 100° F. to about 120° F. and preferably about 110° F. may be employed. Using wash water of the temperature contemplated by this invention will not only significantly reduce the amount of energy required to heat the wash water, thereby saving precious resources, but also effect a savings in the user's energy costs.

While the temperatures at which the products of this invention are designed to work are below those temperatures currently being used in machine dishwashers, the embodiments of this invention will also perform effectively at the currently used temperatures, i.e., at about 130° F. and above. Thus, it will not be necessary for users such as homeowners who have general purpose water heaters thermostatted to deliver water at a higher temperature than that contemplated by this invention to reset their water heater's thermostat. However, for those users such as restaurants whose hot water heaters are tied solely to their dishwashing machines, immediate savings in energy use and therefore costs should be effected by using the embodiments of this invention.

BEST MODE FOR CARRYING OUT THE INVENTION

The present invention is illustrated by, but not limited to, the following examples.

EXAMPLE I

Low Temperature Machine Dishwashing Composition

A dry powder, low temperature machine dishwashing detergent composition was prepared by blending together the following ingredients:

| | | percent by weight |
|---|---|---|
| sodium tripolyphosphate | | 34 |
| sodium metasilicate (anhydrous) | | 10 |
| sodium carbonate (anhydrous) | | 40 |
| chlorine bleach (57% active Cl)[1] | | 1.2 |
| blend of three nonionic surfactants | | |
| low-foaming surfactant[2] | 2 wt. % | |
| oil-soluble surfactant[3] | 2 wt. % | |
| high-foaming surfactant[4] | 4 wt. % | |
| | | 8 |
| sodium sulfate | | balance |
| | | 100.0 |

[1]Sodium dichlorocyanurate
[2]Pluronic 25R2
[3]Alfonic 610-50-ethoxylate
[4]Alfonic 1412-60-ethoxylate The foregoing composition was used in a household dishwashing machine in an amount providing a detergent concentration in an aqueous wash solution of about 0.25 weight percent. The water used to make up the wash solution had a temperature of about 110° F. and had a hardness of about 140 ppm. The obtained wash solution provided effective dishwashing.

EXAMPLE II

Low Tripolyphosphate Dishwashing Composition

A dry powder, low-phosphate detergent composition was prepared by blending together the following ingredients:

| | | percent by weight |
|---|---|---|
| sodium tripolyphosphate | | 17 |
| sodium carbonate | | 20 |
| sodium silicate powder ($SiO_2/Na_2O$ = 2.4) | | 5.5 |
| bleach (57% active Cl)[1] | | 1.2 |
| blend of water-soluble, liquid nonionic surfactants | | |
| low-foaming surfactant[2] | 3 | |
| high-foaming surfactant[3] | 1 | |
| oil-soluble surfactant[4] | 2 | |
| | | 6 |
| sodium sulfate | | 50.3 |
| | | 100.0 |

[1]Sodium dichloroisocyanurate
[2]Pluronic 25R2
[3]Neodol 25-7
[4]Neodol 25-3

The foregoing composition was used in a commercial dishwashing machine in an amount providing a detergent concentration in an aqueous wash solution of about 0.25 weight percent. The water used to make up the wash solution had a temperature of about 110° F. and had a hardness of about 140 ppm. The obtained wash solution provided effective dishwashing.

EXAMPLE III

Low tripolyphosphate Dishwashing Composition

A dry powder, low-phosphate detergent composition was prepared by blending together the following ingredients:

| | | percent by weight |
|---|---|---|
| sodium tripolyphosphate | | 17 |
| sodium carbonate | | 20 |
| sodium silicate powder ($SiO_2/Na_2O$ = 2.4) | | 5.5 |
| bleach (57% active Cl)[1] | | 1.2 |
| blend of water-soluble, liquid nonionic surfactants | | |
| oil-soluble surfactant[2] | 1 | |
| high-foaming surfactant[3] | 2 | |
| low-foaming surfactant[4] | 3 | |
| | | 6 |
| sodium sulfate | | 50.3 |
| | | 100.0 |

[1]Sodium dichloroisocyanurate
[2]Neodol 25-3
[3]Neodol 25-7
[4]Pluronic 25R

The foregoing composition was used in a commercial dishwashing machine in an amount providing a detergent concentration in an aqueous wash solution of about 0.25 weight percent. The water used to make up the wash solution had a temperature of about 110° F. and had a hardness of about 140 ppm. The obtained wash solution provided effective dishwashing.

EXAMPLE IV

Low Temperature Machine Dishwashing Composition Containing No Silicate Component A dry powder, low temperature machine dishwashing detergent composition was prepared by blending together the following ingredients:

| | | percent by weight |
|---|---|---|
| sodium tripolyphosphate | | 34 |
| sodium carbonate (anhydrous) | | 46.8 |
| chlorine bleach (57% active Cl)[1] | | 1.2* |
| blend of three nonionic surfactants | | |
| low-foaming surfactant[2] | 2 wt. % | |
| oil-soluble surfactant[3] | 4 wt. % | |
| high-foaming surfactant[4] | 2 wt. % | |
| | | 8 |
| sodium sulfate | | balance |
| | | 100.0 |

*0.2% can be replaced by a defoamer to minimize foaming. Mazer product MAZU DF 2305X can be used.
Notes 1–4 are the same as in Example I.

This example washes dishes as well as Example I, and the absence of silicate is not noticeable for most purposes and represents a practical alternative.

What is claimed is:

1. A detergent composition suitable for machine dishwashing at lowered washing temperature which consists essentially of: a chelating agent for sequestering the calcium and magnesium ions expected to be present in the wash water; alkaline material providing an alkalinity of at least 12% alkali metal oxide; a water-soluble oxidizing bleach in an amount supplying about 0.3 to about 3.0 weight percent of the composition of an oxidizing component selected from the group consisting of chlorine and oxygen; and certain combinations of nonionic surfactants:

A. a low-foaming water-soluble polyol which is polyoxypropylene-terminated block copolymer having a polyoxyethylene core;

B. an oil-soluble condensate of about 1 to about 5 moles of ethylene oxide with a hydrophobic organic compound containing a single —OH group; and C. a high-foaming water-soluble condensate of at least about 7 moles of ethylene oxide with a hydrophobic organic compound containing a single —OH group, all three surfactants being present in at least 1% for a total of at least 7%.

2. The detergent composition in accordance with claim 1 wherein said chelating agent is selected from the group consisting of alkali metal tripolyphosphate and alkali metal hexametaphosphate.

3. The detergent composition in accordance with claim 2 wherein said chelating agent is present in an amount of about 10 to about 20 weight percent, and wherein a carbonate compound selected from the group consisting of alkali metal carbonate, bicarbonate and sesquicarbonate is present in an amount providing a carbonate-to-phosphate weight ratio of at least about 2:1.

4. The detergent composition in accordance with claim 2 wherein said phosphorous-containing chelating agent is present in an amount of about 25 to about 45 weight percent.

5. The detergent composition in accordance with claim 1 wherein said alkaline material provides an alkalinity of at least about 20 weight percent alkali metal oxide.

6. The detergent composition in accordance with claim 1 further containing at least 2.8 weight percent of soluble $SiO_2$ in the form of an alkali metal silicate powder.

7. The detergent composition in accordance with claim 6 wherein said alkali metal silicate powder is sodium silicate having a $SiO_2/Na_2O$ weight ratio of about 2.4:1.

8. The detergent composition in accordance with claim 1 wherein all three nonionic surfactants are present in a total amount of about 7 to about 10 weight percent.

9. the detergent composition in accordance with claim 1 wherein said low-foaming, water-soluble polyol is a polyoxypropylene-terminated block copolymer having a polyoxyethylene core and an average molecular weight of about 2,000 to about 4,000 and containing about 2 to about 9 moles of propylene oxide per molecule of polyoxyethylene.

10. The detergent composition in accordance with claim 1 wherein said oil-soluble condensate of ethylene oxide with a hydrophobic organic compound containing a single —OH group is an ethoxylated linear $C_{12}$–$C_{15}$ alkanol containing about 2 to about 3.5 moles of ethylene oxide per mole of alkanol.

11. The detergent composition in accordance with claim 1 wherein said oil-soluble condensate of ethylene oxide with a hydrophobic organic compound containing a single —OH group is an ethoxylated linear $C_6$–$C_{10}$ alcohol mixture which has been ethoxylated to an extent such that about 50 percent by weight of the final material is comprised of ethylene oxide moieties.

12. The detergent composition in accordance with claim 1 wherein said high-foaming, water-soluble condensate of at least about 7 moles of ethylene oxide with a hydrophobic organic compound containing a single —OH group is an ethoxylate of a monohydric compound selected from primary linear $C_{12}$–$C_{18}$ alkanols and octyl and nonyl phenols containing about 7 to about 20 moles of ethylene oxide per mole of alkanol.

13. The detergent composition in accordance with claim 12 wherein said high-foaming, water-soluble condensate is a mixture of ethoxylated linear $C_{12}$–$C_{15}$ alkanols containing about 7 to about 9 moles of ethylene oxide per mole of alkanol.

14. The detergent composition in accordance with claim 1 wherein said water-soluble oxidizing bleach is sodium dichloroisocyanurate and is present in an amount of about 0.7 to about 1.5 weight percent.

15. The detergent composition in accordance with claim 1 which additionally contains sodium sulfate as water-soluble filler.

16. A process for machine washing dishes which comprises:

loading said washing machine with dishes;

adding a composition prepared in accordance with claim 1 as the detergent; and washing said dishes with water at a temperature of about 100° F. to about 120° F.

* * * * *